US007631771B2

(12) United States Patent
Nagel et al.

(10) Patent No.: US 7,631,771 B2
(45) Date of Patent: Dec. 15, 2009

(54) MERCHANDISING TRAY FOR FOOD PRODUCTS AND THE LIKE

(75) Inventors: Thomas O. Nagel, Blairstown, NJ (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 493 days.

(21) Appl. No.: 11/248,682

(22) Filed: Oct. 11, 2005

(65) Prior Publication Data

US 2007/0075028 A1 Apr. 5, 2007

Related U.S. Application Data

(60) Provisional application No. 60/722,228, filed on Sep. 30, 2005.

(51) Int. Cl.
*A47F 7/00* (2006.01)

(52) U.S. Cl. ..... 211/59.3

(58) Field of Classification Search ..... 211/59.2, 211/59.3, 74, 174; 312/60, 72, 61, 45, 81; 221/6

See application file for complete search history.

(56) References Cited

U.S. PATENT DOCUMENTS

| | | | | |
|---|---|---|---|---|
| 2,258,170 | A | 10/1941 | Austin et al. | |
| 4,105,126 | A * | 8/1978 | Deffner et al. | 211/59.2 |
| 4,830,201 | A | 5/1989 | Breslow | |
| 4,898,282 | A * | 2/1990 | Hawkinson et al. | 211/49.1 |
| 5,413,229 | A | 5/1995 | Zuberbuhler et al. | |
| 5,458,248 | A | 10/1995 | Alain | |
| 5,469,976 | A | 11/1995 | Burchell | |
| 5,613,621 | A | 3/1997 | Gervasi | |
| 6,155,437 | A | 12/2000 | Rassent | |
| 6,155,438 | A | 12/2000 | Close | |
| 6,357,606 | B1 * | 3/2002 | Henry | 211/59.3 |
| 2004/0079715 | A1 * | 4/2004 | Richter et al. | 211/59.3 |
| 2004/0200789 | A1 * | 10/2004 | Woodbury | 211/59.2 |
| 2006/0196840 | A1 * | 9/2006 | Jay et al. | 211/59.2 |
| 2007/0039908 | A1 * | 2/2007 | Bergdoll | 211/59.3 |

* cited by examiner

*Primary Examiner*—Sarah Purol
(74) *Attorney, Agent, or Firm*—St. Onge Steward Johnson & Reens LLC

(57) ABSTRACT

A two-piece, adjustable width merchandising tray for the organized display of multiple product containers. Two L-shaped tray sections, formed of plastic material. The bottom portions of the two L-shaped sections are provided with laterally extending, interengaging fingers that enable the width of the tray to be adjusted for different product sizes while maintaining substantial continuity to the surface of the bottom structure for containment of product leakage. An asymmetrical side wall arrangement with a forwardly projecting hand grip at the front of one of the side walls enables individual trays to be removed and replaced from a closely packed array of trays arranged in side-by-side fashion. The trays can be conveniently lifted and carried for product restocking, reorganizing, tray cleaning, etc. A simple pull strip and paddle arrangement enables product to be fronted at all times. Double stacking of product containers is also accommodated. Densely stacked, attractive, and efficiently serviced product displays are facilitated.

7 Claims, 13 Drawing Sheets

MERCHANDISING TRAY FOR FOOD PRODUCTS AND THE LIKE

RELATED APPLICATIONS

This application is related to and claims the priority of provisional applications Ser. No. 60/722,228, filed Sept. 30, 2005.

BACKGROUND OF THE INVENTION

The invention is directed to the mass merchandising of packaged food products, and particularly to products such as ice cream and yogurt, for example, that are typically displayed in refrigerated display cases.

Ice cream and yogurt frequently are marketed in round containers, provided with a removable top. Ice cream containers quite typically are tapered, with the larger diameter at the top. The containers may be provided in several sizes, such as pints, quarts, etc. Yogurt also is frequently packaged in round, tapered containers, with the larger diameter sometimes being at the bottom and sometimes at the top.

A great deal of store manpower is expended in loading the display cases, in an effort to provide an orderly and neat-appearing display of the merchandise. Additionally, merchandise such as ice cream and yogurt is perishable, and the stores try to be careful when restocking to place the new merchandise at the back of the display. This frequently is difficult and time consuming because of limited space in the display cabinets, with closely spaced overhead shelving restricting access to backs of the displays.

Notwithstanding the best intentions of the store keepers, their efforts to maintain a neat and orderly display frequently are frustrated by customer interactions. For example, a customer may remove an item from one area of the display, change his or her mind and replace it in a disorderly manner and/or in a wrong location in the display. Inasmuch as disorderly displays and misplaced merchandise tends to result in lower sales of the product, a great deal of time and effort of store personnel is devoted to the process of reorganizing and restocking products such as ice cream and yogurt.

SUMMARY OF INVENTION

The present invention is directed to a novel form of merchandising tray for the display of products, such as ice cream and yogurt, in neat, individual columns over the full depth of the available shelving, which assures that the merchandise will be maintained in a neat and orderly fashion, easily identified by the consumer and easily removable by the consumer without disturbing the selected display arrangement, or neighboring displays. To advantage, the tray is of molded plastic construction, formed of two interengaging L-shaped tray sections, which are adjustable in width over a selected range of widths. The trays thus can be adjusted to the narrowest width suitable to accommodate the specific product containers, thereby maximizing the space available to the store operator to display a full variety of the merchandise. A convenient, built-in sizing chart simplifies and expedites the appropriate adjustments.

In accordance with one advantageous feature of the invention, the two L-shaped tray sections include vertical side wall portions integrally joined with horizontal bottom wall portions. The bottom wall portions include interlocking fingers projecting laterally at spaced locations along the length of the bottom wall portion, with the interlocking fingers with the one tray section fitting closely in spaces between the interlocking fingers of the opposite section. The preferred arrangement is such that, in any width-adjusted position of the tray sections, the bottom structure is substantially continuous. Particularly for products such as ice cream and yogurt, for example, there sometimes can be leakage of the product from its container. The tray of the present invention enables such leakage to be substantially confined within the tray itself, avoiding drippage onto the supporting shelf or, in the case of wire rack shelving, drippage down to lower areas of the display to create an unsightly and unsanitary mess. With the tray of the invention, whenever a leakage occurs, the entire tray may be quickly and easily removed from the display, cleaned as necessary, and replaced into the display.

In an advantageous form of the new merchandise tray, the side wall portions extend to a height well above the height of a single product container, facilitating the display of the product on a double-stacked arrangement for optimum density of product items in the display. Inasmuch as the opposed side walls of the tray are width-adjusted to closely fit the size of the product containers, the double-stacked display remains stable during removal of individual product items from the front of the display by customers.

It is contemplated that, in a typical store display utilizing the merchandising tray of the invention, multiple trays will be closely packed in a side-by-side arrangement along the length of the display area, such that the product can be displayed on a high density basis for maximum product exposure in a given shelf area. To facilitate such a high density display, the merchandising tray of the invention includes a hand-engageable opening at the front of one of the side wall portions of the tray. The hand-engageable opening preferably is provided in only one side wall portion of the tray, and the opposite side wall portion is recessed in the same general area in which the hand opening is provided in the opposite side. Accordingly, when a series of trays are densely packed on a side-by-side basis, the recess provided in one front wall portion of one tray allows for the hand-engageable opening of an immediately adjacent tray to be grasped without interference. This arrangement is such that, in a densely packed group of trays, any one tray can be engaged and drawn forwardly out of the display for restocking, reorganizing, cleaning or the like. This is a particularly valuable practical feature, in that withdrawing the entire tray from a display greatly facilitates the operations involved in restocking and/or reorganizing the display. These operations can be conveniently performed even though the display shelving leaves minimal vertical clearance above the displayed product items.

Complete withdrawal of the merchandising tray from a display arrangement greatly facilitates back loading of the tray, such that the oldest product remains up in front and the newest containers are placed at the back. All store owners desire to do this, of course, but frequently the nature of the display makes it difficult or inconvenient to do so with consistency. With the tray fully removed from the display area or at least pulled forwardly, restocking in the desired manner is easily accomplished. Moreover, as an advantageous feature, the side walls of the tray are provided with hand-engageable openings along the top edges thereof which make it easy for store personnel to lift and carry a fully or partially loaded tray to simplify removal from and replacement in the display cabinet.

The merchandising tray of the invention advantageously incorporates a simple and inexpensive pull strip feature, which enables product from the back portions of the tray to be advanced, with product advantageously fronted at the fore of the display. Pull strip arrangements per se are well known. However, the particular arrangement provided in the merchandising tray of the invention is specifically advantageous for incorporation in the tray of the invention.

A typically preferred embodiment of the invention incorporates break-away sections at the back of the tray, such that the front-to-back length of the tray may be shortened, if necessary, to accommodate narrower shelving. Such break-away sections, in themselves known, are optimized for the shelf of the invention by having the break-away lines of weakness extend generally centrally through the interlocking fingers located in the area of the brake-away. Thus, when a section is broken away at the back of the tray, at least a portion of the backmost interlocking finger remains to maintain the integrity and appearance of the bottom structure at the back of the tray.

Especially in ice cream and yogurt displays, frequently the only identification of the product is that which is applied to the body of the container. When containers at the front of a display become misplaced, or rotated at an inconvenient angle, it is sometimes difficult for a customer to locate a particular desired flavor. In the merchandising tray of the invention, the bottom end portion advantageously is provided at the front edge with an upwardly opening slot of a size and configuration to slidingly receive a label-holding extrusion which can contain identification, pricing and other information relating to the product located behind, in the tray. Advantageously, the label-holding extrusion is supported in an upright orientation and serves additionally as a front stop for merchandise being pushed forward by actuation of the pull strip feature discussed above.

For a more complete understanding of the above and other features and advantages of the invention, reference should be made to the following detailed description of a preferred embodiment, and to the accompanying drawings.

DESCRIPTION OF A PREFERRED EMBODIMENT

Figure 1:
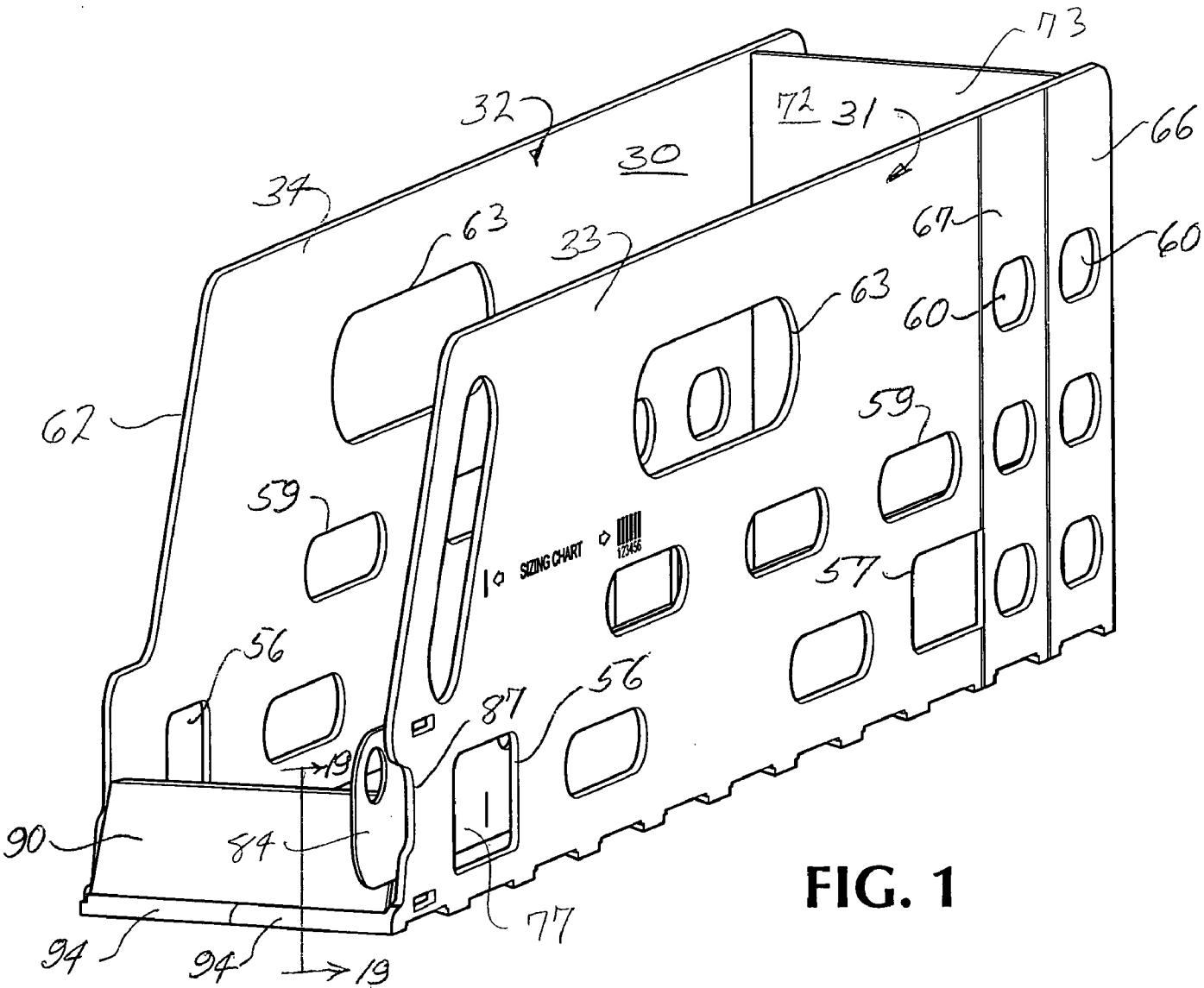
FIG. 1 is a perspective view of the merchandising tray of the invention.

Referring now to the drawing, the reference numeral 30 designates generally a merchandising tray according to the invention comprised of first and second tray sections 31, 32, each comprised of a vertical side wall 33 or 34 and a horizontal bottom wall 35 or 36. The two tray sections 31, 32 advantageously are of molded plastic construction, advantageously formed of a mixture of styrene and K-resin providing desirable characteristics of hardness, gloss, low friction and durability.

The trays of the invention may come in a variety of sizes to suit product requirements. In a typical and non-limiting example, the tray may have an overall length of around 22 inches, a height of around 6.5 inches, and a width which is adjustable in a range of around 2.7 to 3.3 inches. It is contemplated that the trays will be provided in several basic lengths-widths combinations, in each case having a range of width adjustment. In addition, the trays advantageously will provided with break-away sections at the back end, to be described, which will accommodate shortening of the trays to fit narrower shelves.

In each of the tray sections, the side walls and bottom walls are integrally molded and relatively rigid. Each of the bottom walls 31 advantageously comprises a generally continuous panel 37, 38 and a plurality of interlocking fingers 39, 40 projecting laterally outward from inner edges 41, 42 of the respective bottom panels 37, 38.

Pursuant to the invention, the spaces 43, 44 between adjacent interlocking fingers 39, 40 correspond in width to the width of the fingers of the opposite tray sections. That is, the spaces 43 correspond to the width of the fingers 44 and the spaces 44 correspond in width to the width of the fingers 39. As is evident particularly in FIG. 5, the undersides of the bottom panels 37, 38 are formed with channels 45, 46 of the respective tray sections 31, 32 are formed with channels for the sliding reception of the respective interlocking fingers 39, 40. Preferably, the respective interlocking fingers 39, 40 are of different widths and the recesses 45, 46 that receive them similarly are of different widths. In a typical but non-limiting example, the narrow fingers 39 may have a width of about 0.7 inch while the wider fingers 40 may have a width of around 1.4 inch.

Figure 4:
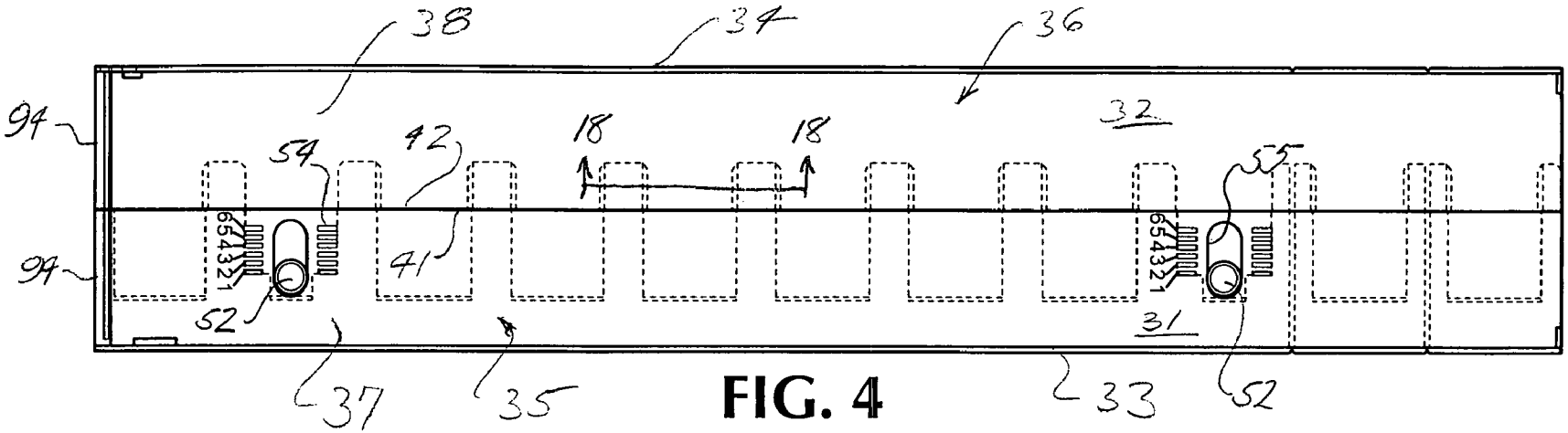
FIGS. 4 and 5 are top and bottom plan views respectively of the tray of FIG. 1, shown in the closed or minimum width position.
Figure 19:
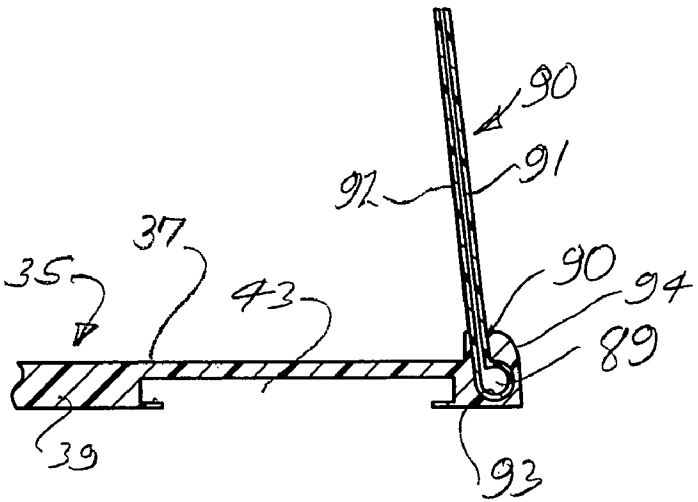
FIG. 19 is an enlarged, fragmentary, cross sectional view as taken generally at line 19-19 of FIG. 1, illustrating the mounting of a label holder at the front of the tray of FIG. 1.
Figure 18:
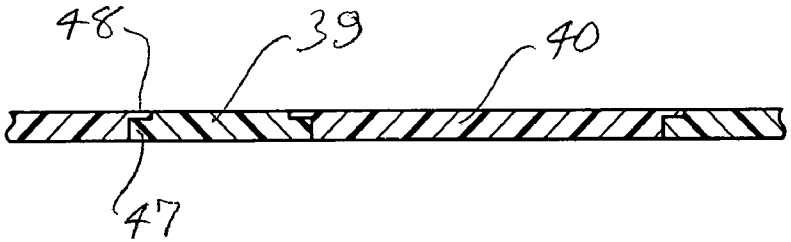
FIG. 18 is an enlarged fragmentary cross sectional view as taken generally on line 18-18 of FIG. 4, illustrating details of the engagement of the respective tray sections.

As shown in FIGS. 18 and 19, the interlocking fingers 399, 40 are provided with laterally extending, interengaging flanges 47, 48 respectively. The flanges 47 extend out from lower portions of the fingers 39, while the flanges 48 extend laterally from upper portions of the fingers 40. The flanges 47, 48 extend over the full length of the respective recesses 45, 46 that receive the interlocking fingers such that, when the two tray halves are joined, the fingers 39, 40 are slidingly interlocked to secure the two tray halves in any of the adjusted positions. As shown in FIG. 4, when the tray sections 31, 32 are adjusted to a minimum width configuration, the inner edges 41, 42 of the respective bottom panels 37, 38 are in contact at the center of the bottom structure. This provides a substantially continuous flat surface over the entire bottom of the tray.

Figure 5:
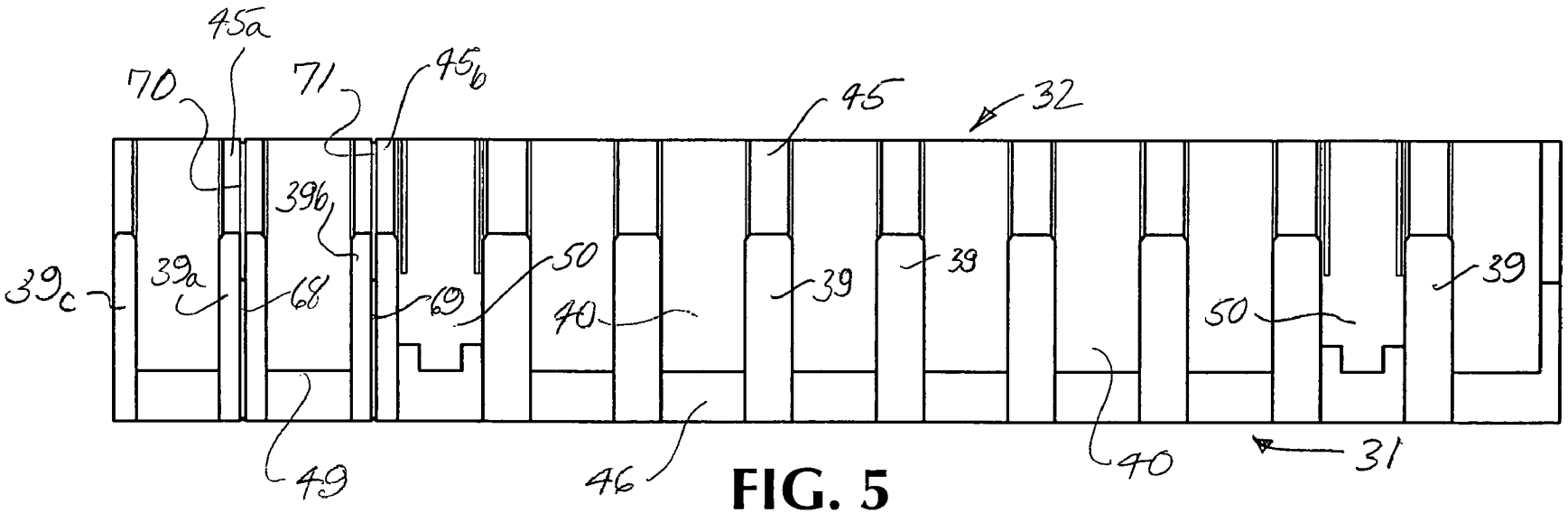
Figure 6:
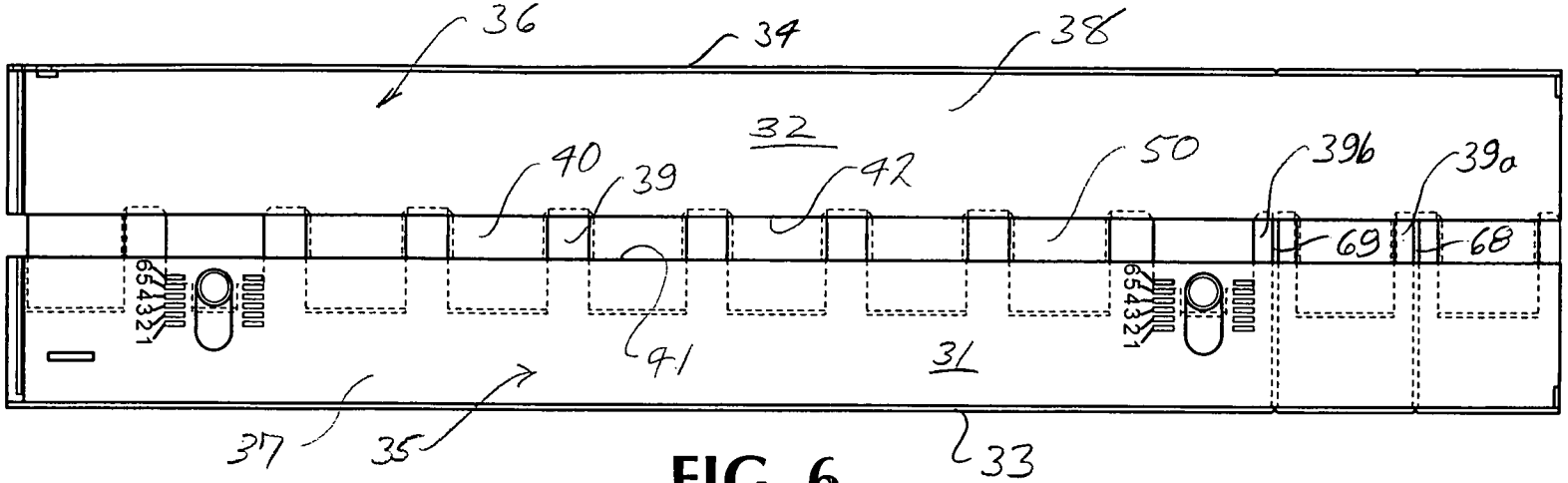
FIGS. 6 and 7 are top plan and bottom plan views respectively of the tray of FIG. 1, shown in an expanded width configuration.
Figure 7:
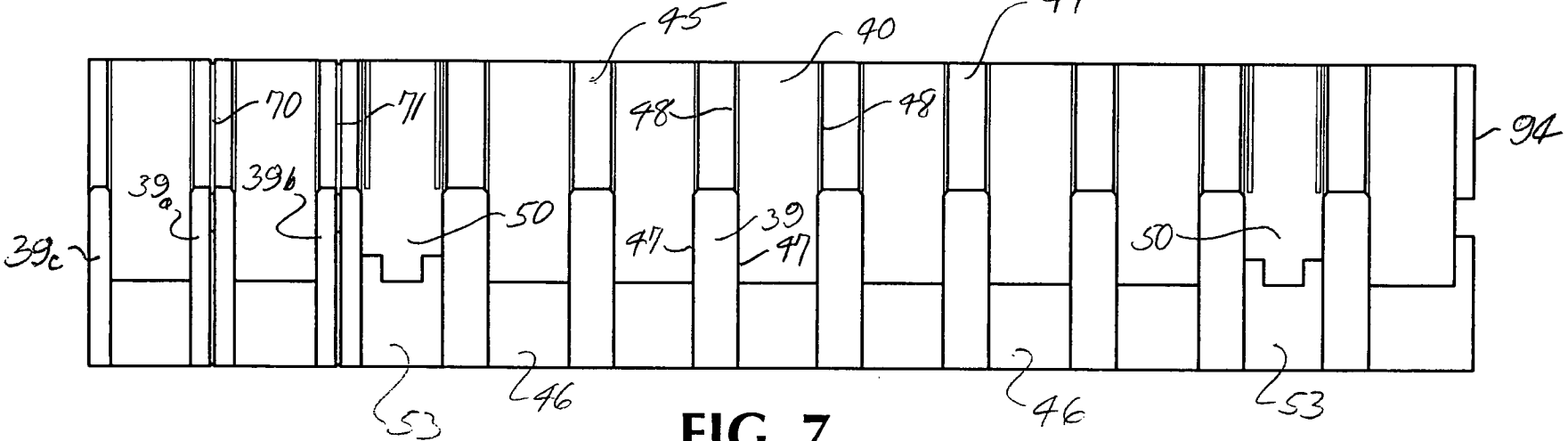
Figure 8:
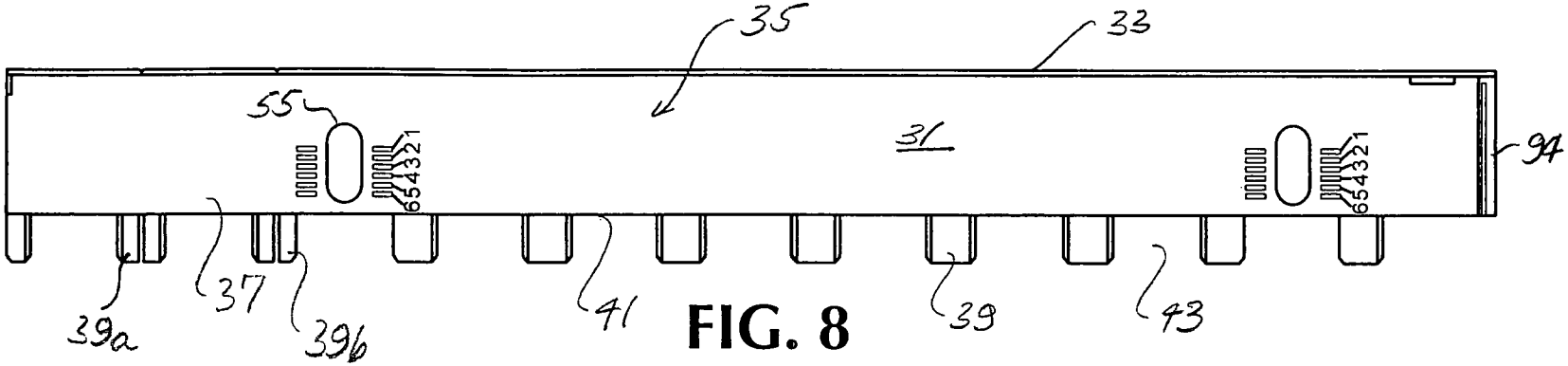
FIGS. 8 and 9 are top plan and side elevational views respectively of one of two tray sections incorporated in the tray of FIG. 1.

FIGS. 6 and 7 illustrate the tray in a configuration of maximum adjustment, in which the inner edges 41, 42 of the respective bottom panels 37, 38 are separated by a predetermined distance, approximately 0.6 inch in the illustrated, non-limiting example. Pursuant to the invention, in this position of maximum width adjustment, both sets of interlocking fingers 39, 40 extend across the full width of the gap and to some degree beyond and into the recesses 43, 44 provided in the undersides of the panels 37, 38. In a preferred embodiment, the wider interlocking fingers provide most of the structural integrity of the assembled tray sections and these fingers advantageously will have a length such that they extend for a substantial distance into their respective recesses 46. When in the narrowest width configuration, as shown in FIG. 5, the wider fingers 40 may, if desired, extend across the full width of the bottom panel 37, limited only by the outer side edges of the panel. In the specific illustration shown in FIGS. 4 and 5, the lengths of the fingers 40 is such that their end extremities 49 terminate short of the side wall of the tray section 31.

The narrower fingers 39, serving a less important structural function, can be somewhat shorter than the wider fingers 40. In all cases, however, the narrower fingers 39 are of sufficient length to extend across the entire gap 50 formed between the panel side edges 41, 42 when the tray is adjusted to its maximum width configuration, as shown in FIG. 6. The arrangement is such that the interlocking fingers 39, 40 serve to provide a substantially closed bottom structure, even when the bottom panels 37, 38 are fully separated, as in FIG. 6. The arrangement is such that a substantially continuous bottom structure is provided in any adjusted configuration of the tray within its maximum and minimum limits. This is a particularly desirable feature for the display of products such as ice cream and yogurt, where there can be occasional leakage of the product. With the tray of the present invention, such leakage is effectively contained within the tray and does not spread to other parts of the display, such as the surface of a solid shelf or to merchandise displayed below, where the tray is supported on a wire structure, for example.

Figure 15:
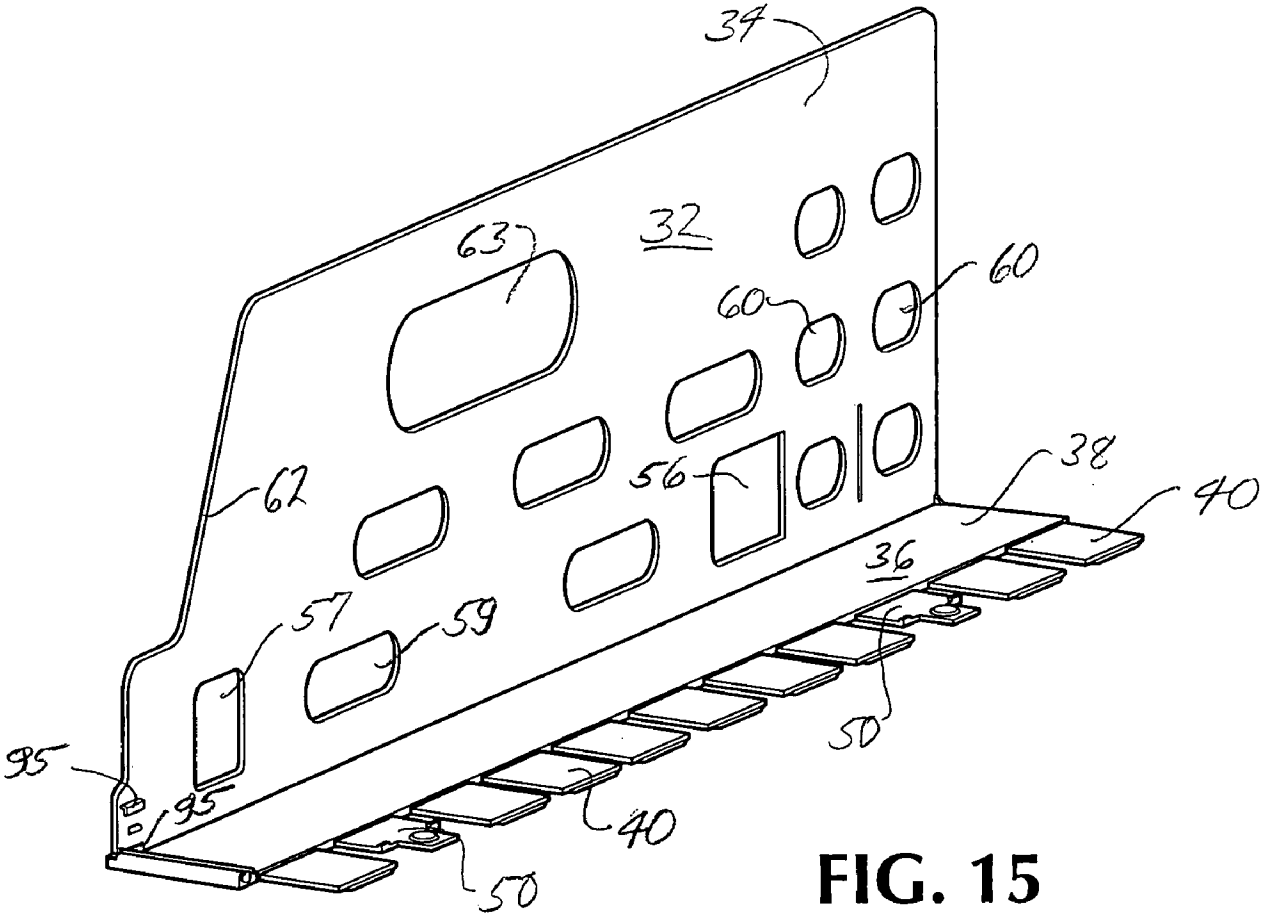
FIGS. 14 and 15 are front elevational and perspective views respectively of the tray section of FIGS. 12 and 13.
Figure 21:
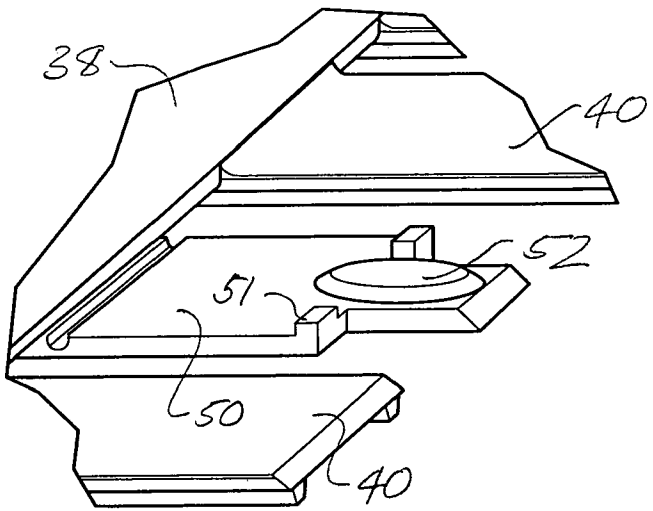
FIG. 21 is an enlarged perspective view illustrating details of the detent element incorporated in the tray section of FIG. 12.

In the merchandising tray of the invention, a simple and effective interlocking detent arrangement is provided for temporarily locking the two tray sections 31, 32 in any of a range of adjusted positions. To this end, the tray section 32 is provided with a pair of widely spaced apart detent fingers 50 (see FIGS. 15, 20, 21), which extend laterally outward from the bottom panel 38, between certain ones of the wide interlocking fingers 40 at locations toward the front and back of the tray section. The detent fingers are provided in outer portions thereof with a pair of upwardly projecting detent lugs 51, positioned on either side of a central pressure pad 52. Spaced apart recesses 53 in the underside of the tray section 31 are arranged to receive the detent fingers 50. In the area directly above the recesses 53 there are provided a series of spaced apart detent openings 54 which are arranged to closely receive the upwardly projecting detent lugs 51.

When the tray is assembled, the detent lugs 51 are aligned with a selected pair of openings 54 at each location to secure the tray in a desired adjusted width configuration. In the illustrated embodiment, there are six pairs of detent openings to provide six adjusted configurations of the tray. As shown particularly in FIG. 20, the bottom panel 37 of the tray section 31 is provided with an elongated opening 55 of a size and shape to accommodate the pressure pad 52 in any adjusted configuration of the tray. In order to set or change the adjusted width of the tray, the pressure pads 52 are depressed to retract, the lugs 51 from the detent openings 54. This enables the two tray sections to be moved laterally, to align the lugs 51 with a different pair of openings 54, after which the pressure pads 52 are released. The resilience of the detent fingers 50 causes the detent lugs 51 to be elevated into the openings 54 as will be understood.

In the tray of the invention, the side walls 33, 34 of the tray sections are provided with side wall access openings 56, 57 opposite the front and back detent positions respectively. These access openings enable a person to extend his or her thumbs through the side walls of the tray sections enabling the tray sections to be gripped and the pressure pads 52 to be depressed, in order to make a width adjustment of the tray. Typically, the tray will be adjusted in width first at one end and then at the other. Calibration numbers, provided adjacent to the detent openings 54, simplify making corresponding adjustments at both ends of the tray.

Figure 3:
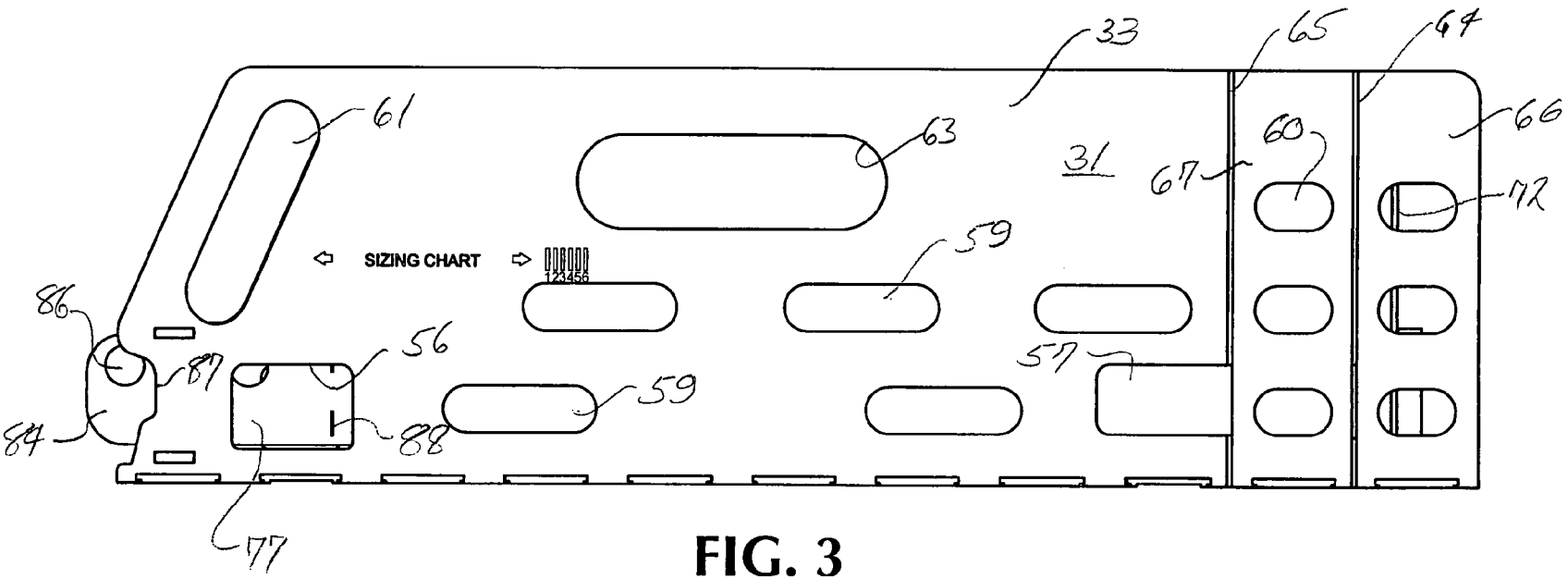

In a particularly preferred embodiment of the invention, a convenient sizing chart is provided on the exterior of the tray to facilitate adjustment of the tray to a proper width for the product to be displayed. As shown in FIGS. 1 and 3, the side wall 33 of tray section 31 is provided with a calibrated sizing chart 97 comprises of a reference line 98 at one side and a series of numbered measuring lines 99 at the opposite side. In the illustrated embodiment, there are six measuring lines, numbered 1-6. For sizing the tray, the larger end of the product container is placed against the sizing chart, with one edge aligned with the reference line 90, The number of the first exposed reference line 99 will indicate to the store clerk the size to which the tray should be optimally adjusted for that product.

Figure 20:
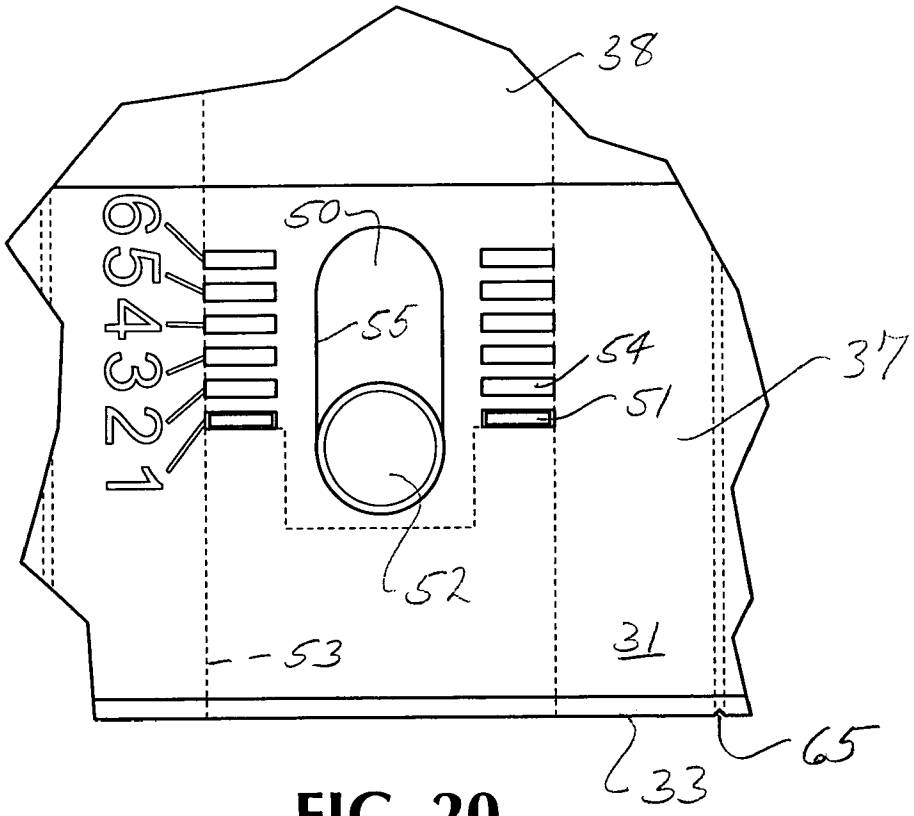
FIG. 20 is an enlarged plan view illustrating details of a detent arrangement for securing the two tray sections in an adjusted-width configuration.

With reference to FIG. 20, six pairs of detent openings 54 are provided, and each is provided with an index number 100. The indexing of the detent openings 54 corresponds with that of the sizing chart 97 such that, if the store employee reads the number "2" when placing a product container against the sizing chart, he or she will set width of the tray so that the detent lugs are received in openings 54 with the index number "2". This automatically sets the tray at the optimum width for the product.

If the size of the product container falls outside the limits of the sizing chart, the store employee knows immediately that a larger or smaller tray will be required.

Figure 23:
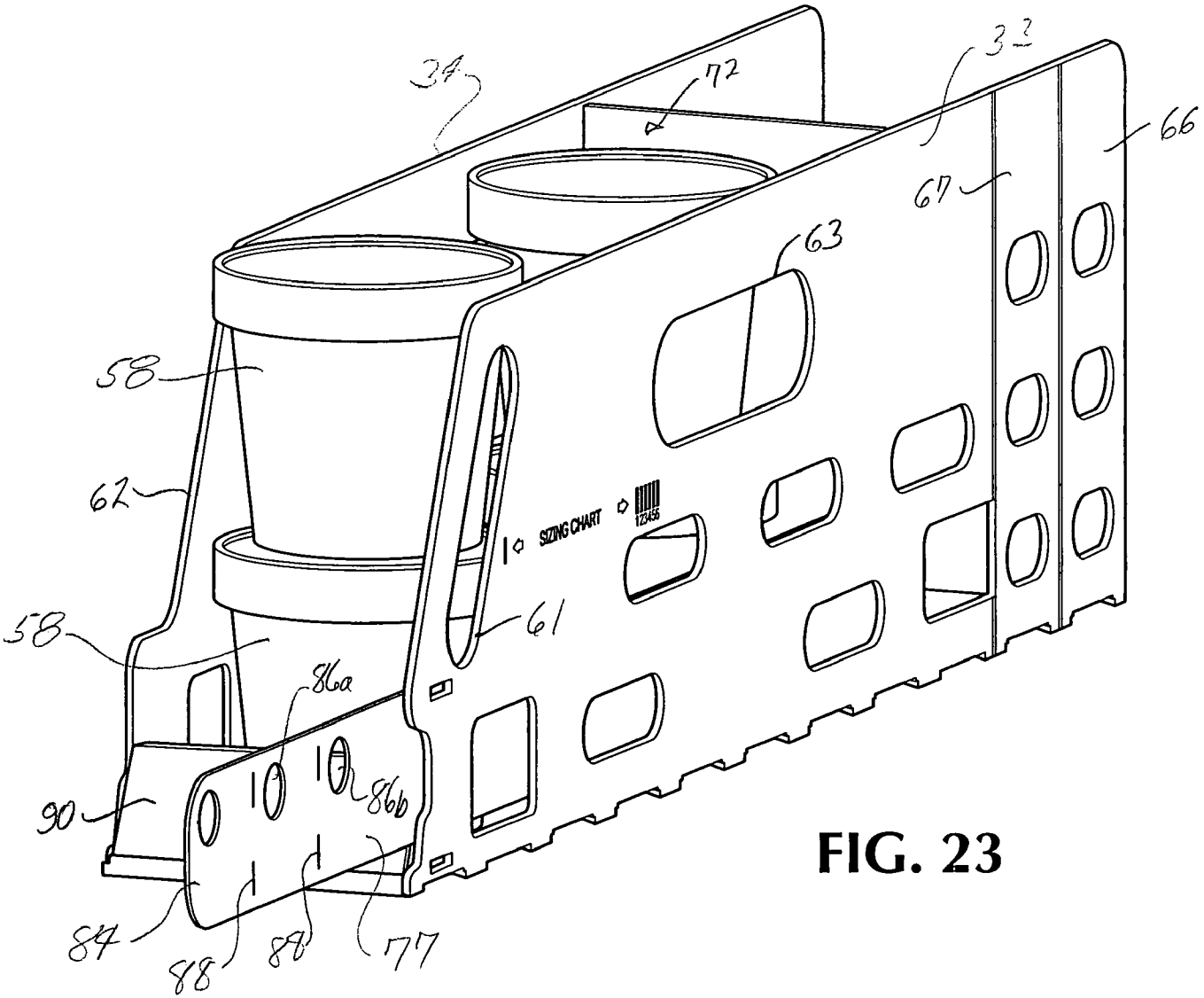
FIG. 23 is a perspective view illustrating a tray according to the invention, loaded with product items in a double-stacked display arrangement and with the pull strip and paddle actuated to bring the product containers to the front of the display.

For the display of ice cream and yogurt products, in particular, but other products as well, the store keeper often desires to present the product in a double-stacked arrangement, as reflected in FIG. 23. Thus, the side walls 33, 34 are constructed to be of a height substantially greater than the height of a single product container, although not necessarily as high as the combined height of two containers 58 stacked one atop the other. In the illustrated example, the height of the side walls is approximately 6.5 inches. In this respect, because the tray can be adjusted in width to provide close lateral confinement of the containers 58, the double-stacking arrangement is quite stable in the display cabinet and allows the store keeper to maximize the quantity of product presented while at the same time maintaining a neat and orderly display.

For refrigerated displays, because the tray side walls are relatively long and high, it is desirable to provide the side walls with numerous through openings 59, 60 to accommodate the lateral flow of refrigerated air into and out of the installed trays.

Figure 2:
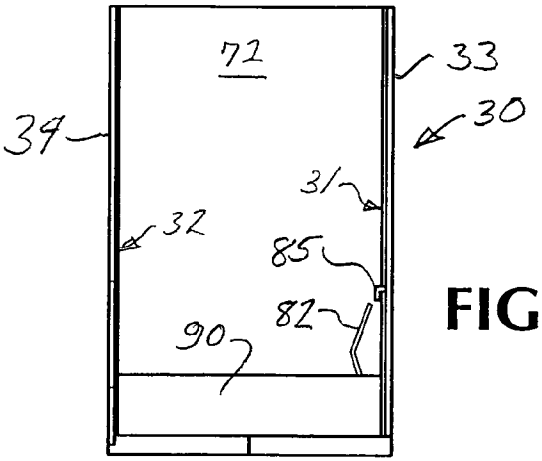
FIGS. 2 and 3 are front and side elevational views respectively of the merchandising tray of FIG. 1.
Figure 22:
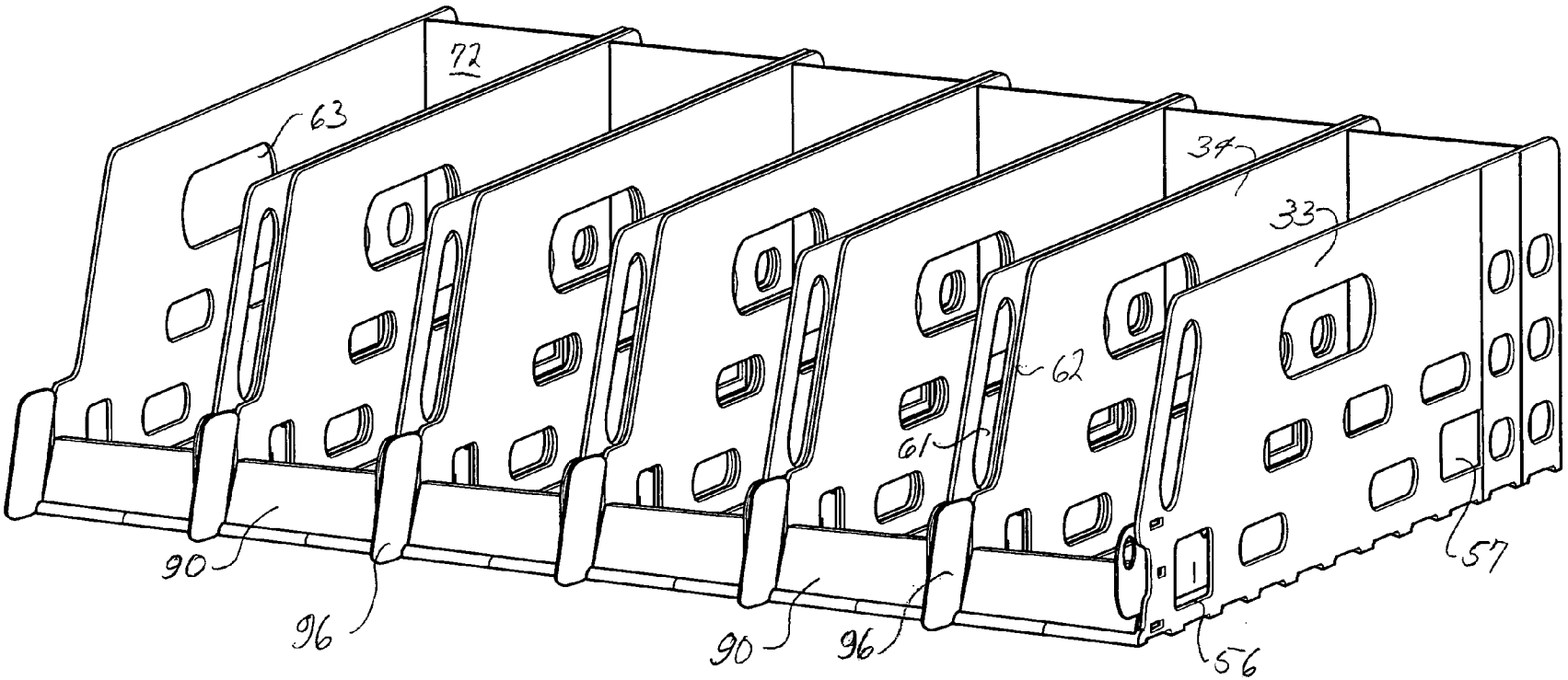
FIG. 22 is a perspective view showing a plurality of merchandising trays according to the invention arranged in a typical, densely packed configuration.

In a typical in-store display utilizing trays of the invention, the trays will not only be adjusted to closely fit the size of the product containers 58, but also will be arranged in tight, side-by-side arrangement, as shown in FIG. 2, in order to achieve optimum density of product in the display. In order to be able to service a particular tray, for reloading, cleaning, reorganizing, etc., it is desired to be able to withdraw any single tray from a tightly packed group thereof. Accordingly, in the tray of the invention, the side wall 33 of tray section 31 is provided adjacent its forward extremity with a vertically elongated opening of a size suitable to be easily engaged by a hand. To advantage, the opposite side wall 34 is not provided with a similar hand-engageable opening, but instead is recessed rearwardly at 62 along an upper portion of its forward edge. The arrangement is such, as reflected in FIG. 22, that when a series of trays are closely stacked in side-by-side relation, the recessed portion 62 of each of the side walls 34 is located so as to expose the hand-engageable opening in the immediately adjacent wall 33 of an adjacent tray. Thus, even with a series of trays densely packed as shown in FIG. 22, store personnel can select any individual tray, engage its opening 61 and pull it forwardly out of the display without disturbing the other trays in any way.

In addition to the front, hand-engageable opening 61, each tray is provided at a mid-point in each of the side walls 33, 34 with a horizontally elongated, hand-engageable opening 63, 64 near the upper edges of the side walls. These openings 63 are positioned to enable a store person to pick up and carry an entire tray, loaded with product, as part of a removal or replacement operation. In this respect, it is contemplated that, for front-loaded displays, the store personnel will in many cases simply remove an entire tray from the display, clean it if necessary, and reload with new merchandise, after moving the existing product inventory on the tray to forward positions. In this respect, with front-loaded displays, particularly where the vertical clearance between shelves is minimal, it can be very difficult to restock a particular product column, by placing new product at the back of the display. With the new tray of the invention, it is a simple matter to withdraw the entire tray from the display cabinet, service and reload it as necessary and replace it within the cabinet. During such reloading, complete access is of course available to the back of the tray, so that proper first-in-first-out loading of the tray can be easily accomplished.

Because commercial shelving comes in several different shelf widths, the merchandising tray of the invention incorporates break-away sections at the back that can be removed, when necessary or appropriate, for installation on narrow shelving. For this purpose, the opposite side walls are provided with molded-in deep vertical grooves 64, 65 forming break-away side wall sections 66, 67. For the tray section 31, the vertical grooves 64, 65 are aligned with similar bottom grooves 68, 69 extending along the center lines of the interlocking fingers 39*a*, 39*b*adjacent the back of the tray (see FIG. 5). By applying suitable twisting force to a break-away section at the back of the tray, the section will separate along the break lines 64, 68 to remove the entire section. With respect to the opposing tray section 32, vertical grooves 64, 65 in the side wall 34 are aligned with similar bottom grooves 70, 71 (FIG. 5) which extend laterally throughout the length of the panel recesses 45*a*, 45*b*, which normally receive the interlocking fingers 39*a*, 39*b*. The break-away sections of the tray section 32 thus can be removed in the same manner as for tray section 31. By locating the break grooves 68, 69 and 70, 71 centrally along the interlocking fingers 39*a*, 39*b*, and their respective guide recesses 45*a*, 45*b*, the back portions of the tray remain properly mechanically interlocked when the individual break-away sections are removed.

In this respect, it will be noted (FIGS. 5 and 7) that the interlocking finger 39*c*, located at the back extremity of the tray section 31, is in the form of a half-width finger, which will correspond substantially to the remaining portions of the fingers 39*a*, 39*b* after tray sections are broken away.

To particular advantage, the merchandising tray of the invention incorporates a highly simplified and economical form of pull strip and pusher paddle, whereby the product containers 58 can be easily brought forward and maintained with a fronted presentation for increased sales appeal. In the tray assembly of the present invention, a pusher paddle 72 is provided, which is of a width suitable to be closely received between the side walls 33, 34 when the tray sections are adjusted to their narrowest configuration. The paddle, shown in FIG. 17, comprises a single molding of relatively rigid plastic, preferably transparent, and comprises a vertical panel 73 and a base panel 74. The base panel 74 extends forwardly and rearwardly of the vertical panel 73, forming guide edges 75 at opposite sides. The forwardly projecting portion of the base desirably is formed with a semi-circular cut-out 76 to "cradle" the circular contours of the contemplated product containers.

A pull strip 77, is formed of a flat, thin, flexible length of plastic material. In an illustrative, but non-limiting example, the pull strip may be about 1.75 inches in height, about 0.022 inch in thickness and about 22 inches in length. The plastic material, which preferably is transparent, may be a material such as polypropylene. At its back end, the pull strip 77 is provided with outwardly inclined edge portions 78 which, together with outwardly projecting arms 79 at the back end extremity of the strip, define vertically opening notches 80 along the top and bottom edges. To advantage, the pull strip may be provided over most or all of its length, and at least the back portion thereof with a longitudinal crease line 81 tending to impart a shallow V-shaped cross section to the pull strip to impart a degree of longitudinal rigidity.

Figure 9:
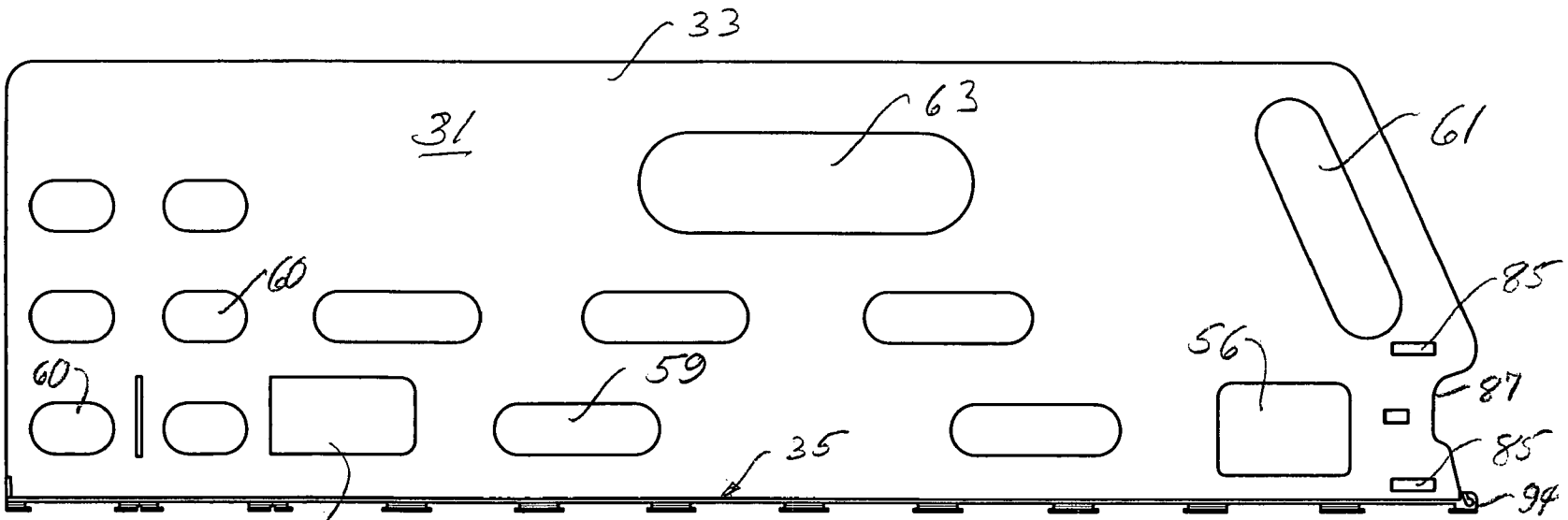
Figure 11:
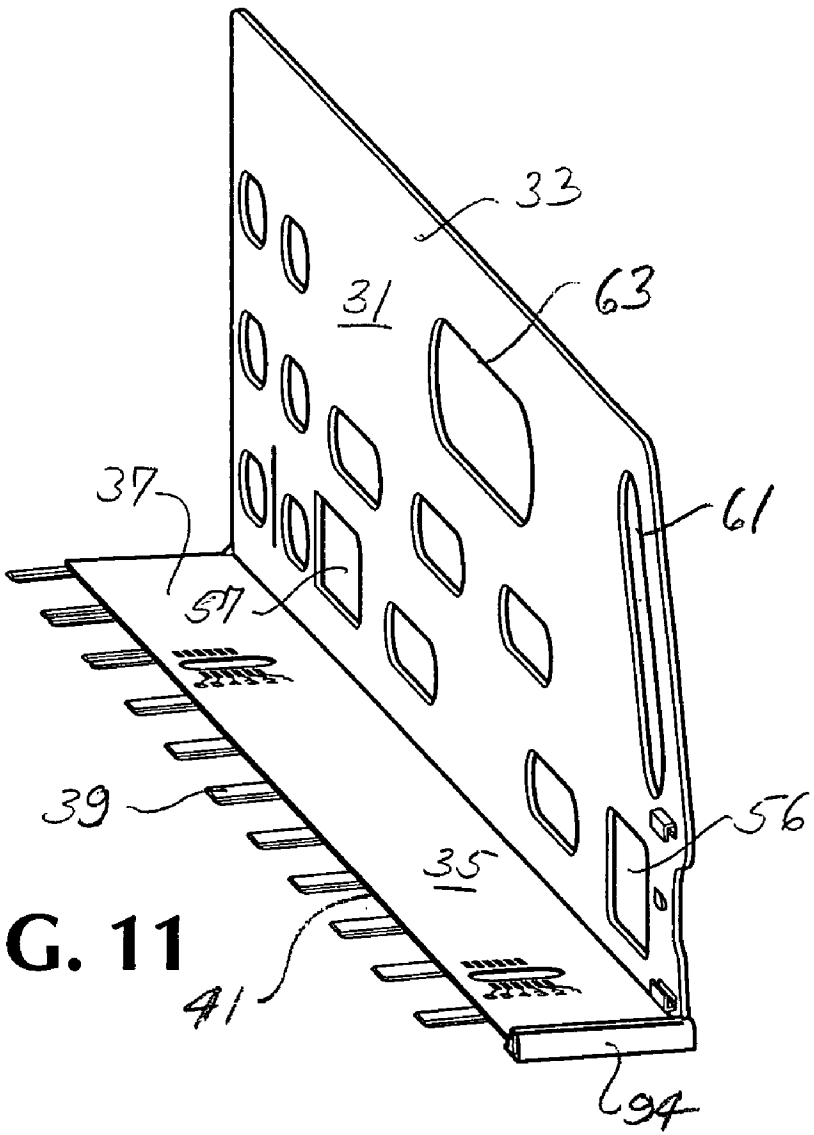
FIGS. 10 and 11 are front elevational and perspective views respectively of the tray section of FIGS. 8 and 9.
Figure 10:
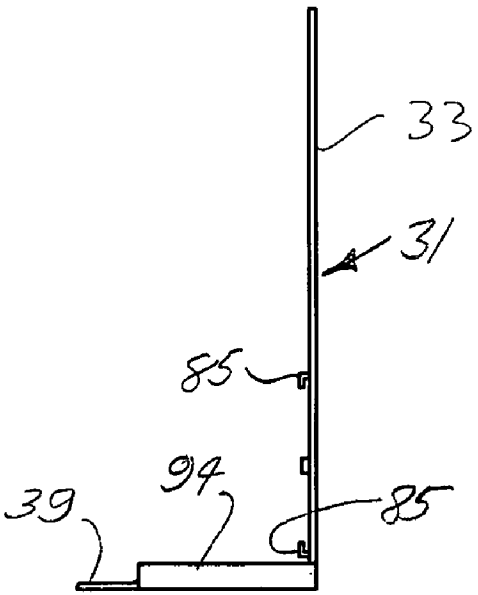
Figure 12:
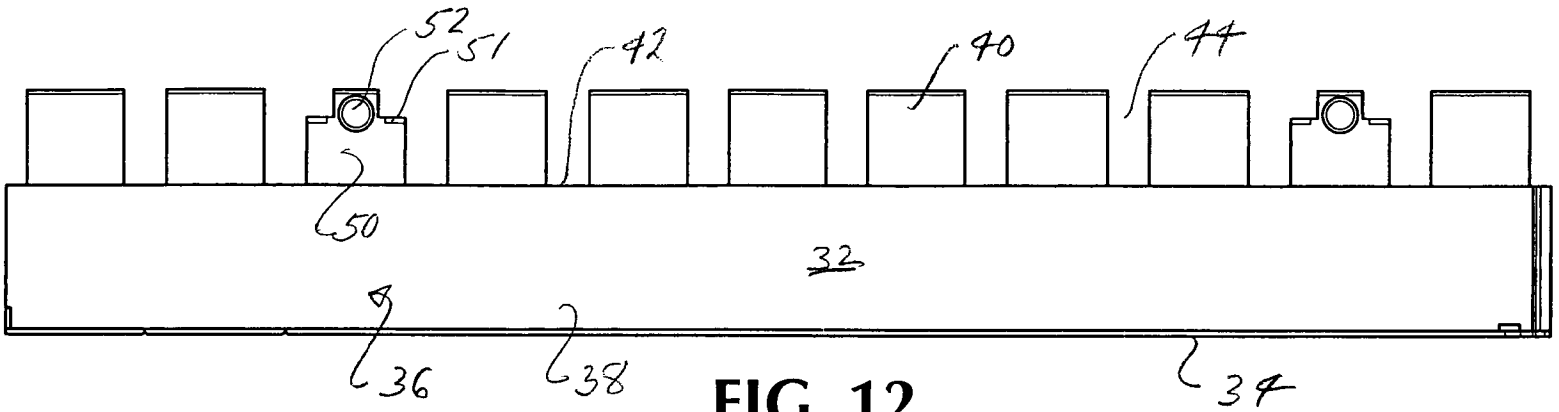
FIGS. 12 and 13 are top plan and side elevational views respectively of a second tray section incorporated in the tray of FIG. 1.
Figure 13:
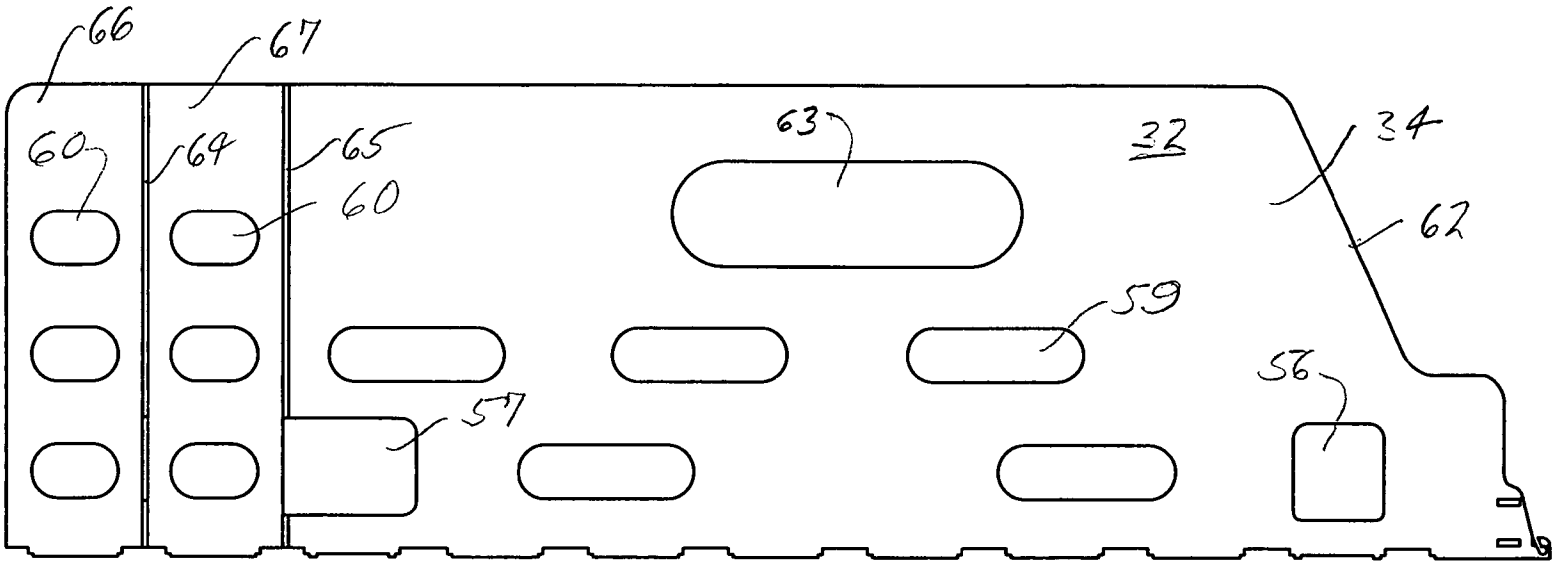
Figure 17:
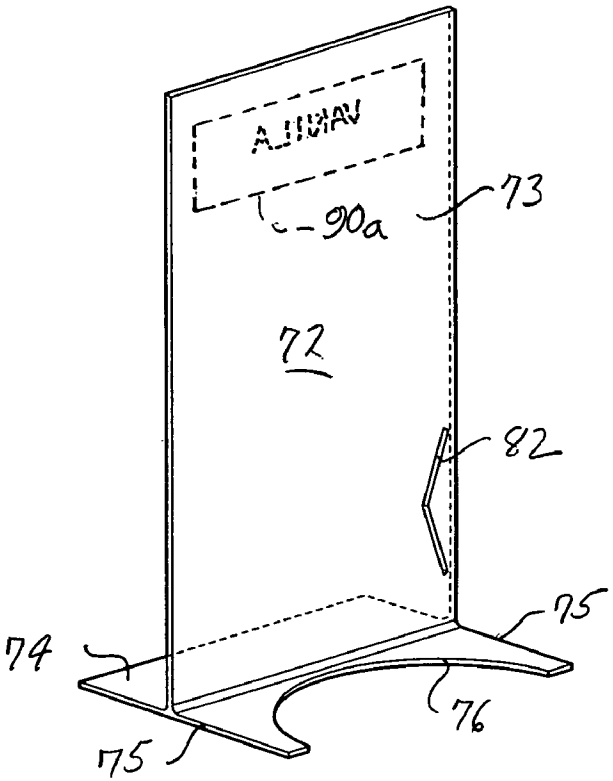
FIG. 17 is a perspective of a pusher paddle used to advantage in the tray of FIG. 1.
Figure 16:
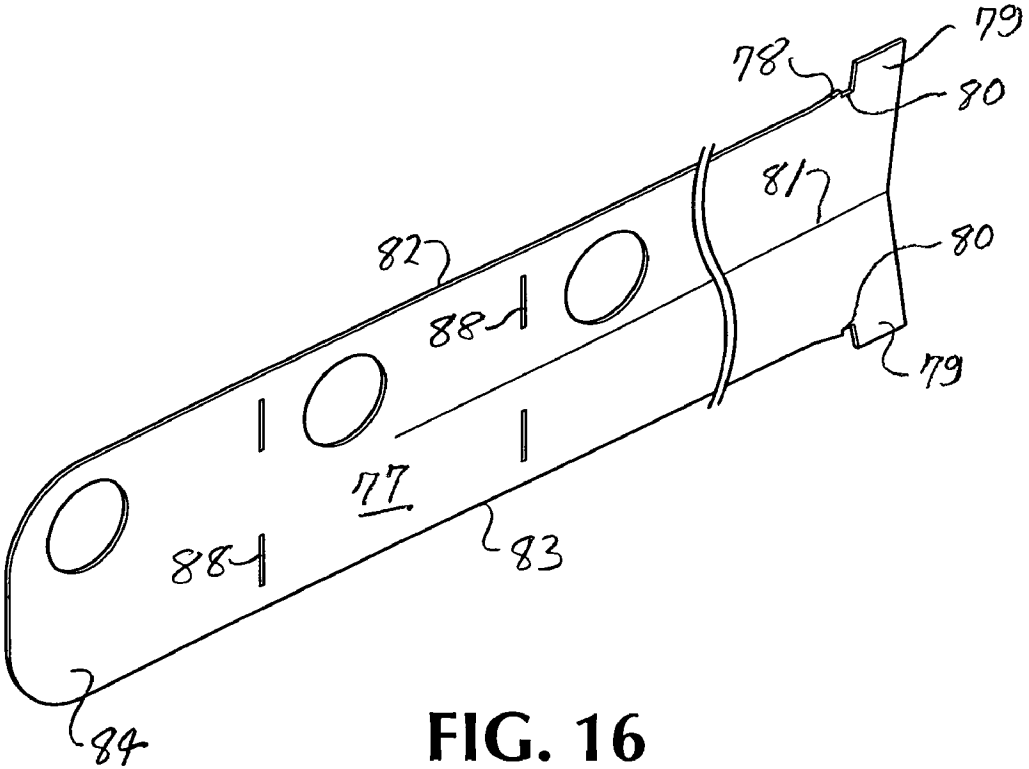
FIG. 16 is a perspective view of a pull strip element utilized to advantage in the tray of FIG. 1.

As shown in FIG. 17, the vertical panel 73 of the paddle 72 is formed along one edge thereof with a slot 82 which also is of a shallow V-shape configuration, of a size to closely receive the principal side edges 83 of the pull strip. To assemble the pull strip 77 with the paddle 72, the front end 84 of the pull strip is inserted back to front into the V-shaped slot 82 and the pull strip is drawn forwardly until the inclined edge portions 78 are forced through the slot 82 and the notches 80 are seated therein. The pull strip and paddle assembly is then installed in the tray by inserting the forward end 84 of the pull strip between opposed L-shaped flanges 85 located at the front of the side wall 33 (FIG. 9).

An installed and retracted position of the paddle and pull strip arrangement is illustrated in FIGS. 1 and 3, for example. The length of the pull strip is such that the forward end 84 thereof projects slightly beyond the forward edges of the side wall 33. A finger hole 86 is provided at the forward edge of the pull strip, and a notch 87 advantageously is formed in the front edge of the side wall 33 to facilitate access to the finger hole 86. Product containers may be pulled forward by engaging the front edge of the pull strip and drawing forward to slide the paddle 72 forward within the tray, as shown in FIG. 23. When the product has been properly moved forward, the pull strip is simply pushed back into the tray to its normal position, as shown in FIG. 3. The paddle 72 being locked to the back end of the pull strip, moves rearwardly with it to the back of the tray.

As will be appreciated, as one or more break-away sections are removed from the tray assembly, the pull strip will tend to project forwardly of its desired position in the display. Accordingly, the pull strip is provided with creases 88 marking where the front of the pull strip may be cut or broken to reduce its length to correspond to the reduced length of the tray itself. Additional finger. holes 86*a*and 86*b* are also provided for use when the pull strip is shortened.

In a preferred form of the invention, the two tray sections 31, 32 are formed at their front end extremities (see FIG. 19) with a lateral slot 89 extending across the full width of the tray section 32 and most of the full width of the tray section 31, being blocked off in that tray section at a point closely adjacent to the side wall 33. The slot 89 is enlarged in the bottom area and narrow at its exit opening 89*a*. A common form of label holder 90 in widespread use comprises front and back panels 91, 92 of plastic material joined integrally at the bottom in a somewhat forwardly projecting flange portion 93. The shape of the slot 89 is such that the label holder can be inserted laterally and held in an upright position at the front of the tray, as shown in FIG. 19. Typically, though not necessarily, the width of the label holder will correspond to the minimum width setting of the tray. When the tray is set at a wider position, the label holder will span the gap between the two tray sections, being supported in part by each of the spaced apart tray sections. The integrally molded front flange section 94, in which the slot 89 is formed, may project slightly above the adjacent bottom surface of the tray section (see FIG. 19) and may serve to some degree as a front stop for the displayed product. However, the label holder 90 extends up to a higher level, for example one inch, and is firmly supported in the slot 89, and thus serves as a highly effective front stop for the product. In addition, and importantly, the label holder allows the product, and product flavors, within the tray to be easily identified by the shopper which frequently is not the case with ice cream and yogurt displays.

Some store displays of frozen goods, such as ice cream and yogurt, are arranged to be accessed from within the cooler, where the cooler provides access to the back ends of the trays. For such applications, it is advantageous to mount an additional label holder 90(*a*) on the back surface of each of the paddle panels 73 (FIG. 17) to enable store personnel to easily identify products from the backs of the trays. The label holders 90(*a*) may be of the same form as the label holders 90, and the back panels thereof may be suitably bonded to the panels 73. Inasmuch as the paddle panels 73 are transparent, product information in the label holders 90(*a*) can also be read from the front of the tray, if necessary.

Figure 14:
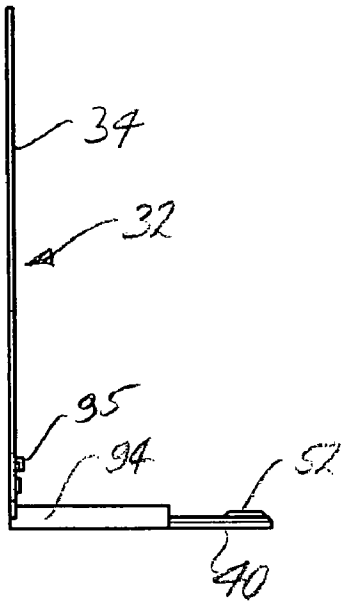

In the illustrated embodiment of the invention, the tray section 32 is provided, at the forward lower extremity of its side wall 34, with opposed L-shaped flanges 95 (FIGS. 14, 15) arranged to receive a horizontal stem portion (not shown) of an attention-getting flag 96 (FIG. 22). This provides a convenient vehicle for announcing special sales, new flavors, etc.

In a preferred embodiment of the invention, the materials utilized for loading the tray sections 31, 32 are chosen to provide adequate strength, a relatively high gloss surface, low friction characteristics and resistance to ultraviolet light. A mixture of KRO3 K-Resin (a styrene-butadiene copolymer) and EA3200 crystal styrene, both available from Chevron Phillips Chemical Company comprise the principal components of the composition, to which are added minor amounts of an ultraviolet resistance material and a Teflon surface modifier. In one advantageous composition, the crystal styrene and K-Resin are provided in approximately equal amounts, in another, the K-Resin component predominates over the crystal styrene in an approximate three to one ratio. In still another advantageous composition, the basic material is MA5350 high gloss, high rigidity, high impact styrene, also available from Chevron Phillips Chemical Company. Minor amounts of anti-ultraviolet and Teflon surface modifier are added. It is understood that the foregoing examples are illustrative and non-limiting. The illustrative compositions provide a tray of attractive appearance, with a smooth, high gloss surface which is easily maintained and cleaned, the low friction characteristics are particularly desirable not only to enable the double-stacked product containers to be drawn forward with the pull strip and pusher arrangement, but also to facilitate individual removal and replacement of trays from a densely packed array thereof for individual reloading and servicing of the trays.

The merchandising tray of the invention provides unique and very significant advantage to the store keeper. By presenting product containers in neat, closely confined columns, double-stacked if appropriate, it is feasible to achieve greater density of product display, in addition to enabling an increased variety of products displayed in a given shelf or cabinet area. The use of shelf dividers for confinement of product columns is of course well known. The present invention, however, enables the product to be displayed in easily removable trays. The store keeper is thus able to dramatically reduce labor costs associated with facing the product at the front of the displays and with rear loading of the product for proper rotation.

The adjustable tray feature enables the tray to closely fit to and thus confine the product column so that optimum product density can be realized. In addition, the close confinement of the product enables double stacking to be utilized and efficiently maintained. The convenient sizing chart feature provided on the outside of the tray side wall, together with the use of correspondingly indexed detent positions for setting the tray width, enables store personnel to quickly and easily set any tray to an optimum width for the product to be displayed therein. This assures the store operator of a maximum density of product in the display and also helps to keep the product containers displayed in a neat and orderly fashion.

It has been observed that customers themselves will make use of the pull strip and pusher feature to bring product to the front of the display for easy retrieval. Thus, after a few product containers are removed from the display by earlier customers, a subsequent customer often finds it more convenient to pull the product column forward than to reach back into the tray for a recessed container. Where this occurs, the store personnel are freed for other duties.

Use of the trays of the invention provides for a much neater and more attractive display of products such as ice cream and yogurt in particular. Typical displays of such products easily become disorderly as individual containers are removed, others are dislodged, tipped over, etc. In many cases, a customer changing his or her mind returns a container to the wrong location, making it difficult for other customers to locate and select desired product flavors, for example. With the tray of the present invention, particular flavors are confined in a particular tray, which easily maintains the inventory in a neat and orderly manner which stimulates sales. Moreover, since the product identification is clearly provided at the front of the tray, in the front-mounted label holder, the customer is much less likely to replace a container in the wrong location.

The ability to remove and replace individual trays not only enables highly efficient, low cost servicing of the display, but also enables the display to be easily and efficiently reorganized as appropriate, with new and different products, simply by bodily removing one tray and its contents and substituting a freshly loaded tray with another product.

The trays are formed of a glossy and lubricious and sturdy material, which facilitates the sliding forward of the product containers using the pull strip element, and also facilitates removal and replacement of the trays themselves. Although the tray of the invention is not intended exclusively for refrigerated displays, it is highly suitable for such utilization. The materials are suitable for low temperature applications, and the trays themselves are formed with large ventilation openings in their side walls to accommodate the flow of refrigerated air to the product.

An advantageous feature of the tray structure is a provision for width-adjustability while maintaining a substantially continuous bottom structure. Accordingly, should there be any leakage of product from their containers, it can be effectively contained within the trays, which can be easily cleaned on an individual basis with much less time and effort than if the leakage were to flow onto underlying shelves or, in the case of wire shelving, onto products being displayed at lower levels. Moreover, the materials of which the trays are molded are smooth, glossy and non-porous, which both inhibits the mold and bacteria growth and also facilitates cleaning when necessary.

Use of the merchandising trays of the invention also helps the store keeper to identify items which are out of stock. Thus, when the items are maintained in an orderly confinement within the tray, an empty tray readily signifies that the product is out of stock. In conventional displays, there may be one or more misplaced items, or items remaining at the back of the display, that make it difficult to reliably ascertain whether a given item is out of stock. To the extent that the restocking task becomes difficult or inconvenient to store personnel, it sometimes does not get performed on a timely basis.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A two-piece adjustable width tray for the organized display of multiple product containers, which comprises (a) first and second opposed tray sections of molded plastic construction and of generally L-shaped cross section, each comprising a bottom wall structure and a side wall portion, (b) the bottom wall structure of each tray section including a smooth, generally continuous bottom wall panel portion of generally rectangular configuration extending longitudinally of a principal tray axis adjacent to and joined along outer edges thereof with the side wall portion of the tray section, and a plurality of longitudinally spaced apart fingers extending laterally from an inner edge of the bottom wall panel portion of each tray section, (c) the fingers of one tray section being closely received in spaces between fingers of the other tray section, whereby said panel portions and said fingers, in any width adjusted position of said tray sections, form a substantially continuous bottom wall structure for the effective containment of flowable materials resulting from product leakage from said containers, (d) said bottom wall panel portions having top and bottom surfaces and inner edges and said inner edges being positionable in close relation, when said tray sections are adjusted to a minimum width configuration, (e) said fingers being integral with said panel portions and having upper surfaces offset below the top surfaces of said panel portions, (f) said bottom wall structure of each of said tray sections being formed with laterally extending, downwardly opening recesses aligned with and arranged for the slideable reception of said fingers to accommodate width adjustment of said tray, whereby said fingers slide at least partially underneath said top surfaces of said panel portions, (g) said bottom wall panel portions having a width at least as great as a length of the fingers received in the recesses in the bottom wall structure thereof whereby, when said tray sections are set to a minimum width configuration, with the inner edges of said panel portions in close relation, end extremities of said fingers of one tray section do not extend beyond the side wall portions of the other tray section, (h) said fingers being of sufficient length to bridge the entire space between the inner edges of said panel portions when said tray sections are set in any adjusted width, whereby said bottom wall panel portions together with said fingers form an effectively continuous tray bottom for the containment of product leakage in any adjusted position of said tray sections, (i) said bottom wall panel portions being of widths greater than a space between said inner edges thereof when said tray is set at a maximum width.

2. An adjustable width tray according to claim 1, wherein (a) one of said side wall portions is provided with a forwardly extending forward edge region thereof with a hand-engageable opening to facilitate withdrawal of a tray from a display, and (b) a forward extremity of the other of said side wall portions is spaced rearwardly of said hand-engageable opening such that, when a multiplicity of said trays are placed in tightly packed, side-by-side relation on a shelf, the hand-engageable opening of the side wall portion of any one tray can be grasped without interference from an adjacent side wall portion of a closely packed neighboring tray.

3. An adjustable width tray according to claim 1, wherein (a) one of said bottom wall panel portions is formed at one or more locations with a plurality of downwardly opening first detent elements located opposite one or more fingers extending from the opposite bottom wall panel, (b) said one or more fingers are provided with one or more upwardly projecting second detent elements engageable with said first detent elements for securing said tray sections selectively in a plurality of predetermined width settings, (c) said one of said bottom wall panel portions is formed with one or more access openings therein directly above a portion of said one or more fingers, (d) said one or more fingers are engageable and downwardly displaceable through said access openings for engaging and disengaging said first and second detent elements, and (e) the side wall portion joined with said one bottom panel has a side wall access opening adjacent each of said one or more bottom wall panel portion access openings to enable manipulation of said one or more fingers through said side wall portions for width adjustment of said tray.

4. A two-piece adjustable width tray for the organized display of multiple product containers, which comprises (a) first and second tray sections of molded plastic construction and of generally L-shaped cross section, each comprising a bottom wall portion and a side wall portion.

(b) the bottom wall portion of each tray section including a smooth, generally continuous bottom wall panel portion of generally rectangular configuration extending longitudinally of a principal tray axis adjacent to and joined along outer edges thereof with the side wall portion of the tray section, (c) said bottom wall panel portions having top and bottom surfaces and inner edges along upper portions of said panel portions, and said inner edges being positionable in close relation, when said tray sections are adjusted to a minimum width configuration, (d) a plurality of longitudinally spaced apart fingers extending laterally from an inner edge of the bottom wall panel portion of each tray section, (e) said fingers being integral with said panel portions and having upper surfaces spaced below the top surfaces of said panel portions, (f) said panel portions each being formed on bottom surfaces thereof with laterally extending, downwardly opening recesses aligned with and arranged for the slidable reception of said fingers to accommodate width adjustment of said tray, whereby said fingers slide at least partially underneath super surfaces of said panel portions, (g) said fingers of at least one tray section and said downwardly opening recesses of at least the other tray section being formed with interengaging flanges along side edges thereof, whereby said first and second tray sections are interlockingly engaged for adjustable movements in the width direction, (h) said bottom wall panel portions having a width at least as great as a length of the fingers received in the recesses in the bottom surfaces thereof whereby, when said tray sections are set to a minimum width configuration, with the inner edges of said panel portions in close relation, end extremities of said fingers are contained within said downwardly opening recesses, (i) said fingers being of sufficient length to bridge the entire space between the inner edges of said panel portions when said tray sections are set in any adjusted width, and said fingers of one tray section being of a width corresponding to spaces between fingers of the other tray section, whereby said bottom wall panel portions together with said fingers form an effectively continuous tray bottom in any adjusted position of said tray sections, (i) said bottom wall panel portions being of widths greater than a space between said inner edges thereof when said tray is set at a maximum width, (k) one of said bottom wall panel portions being formed at one or more locations with a plurality of downwardly opening first detent elements located opposite one or more fingers extending from the opposite bottom wall panel, (l) said one or more fingers being provided with one or more upwardly projecting second detent elements engageable with said first detent elements for securing said tray sections selectively in a plurality of predetermined width settings, (m) said one of said bottom wall panel portions being formed with one or more access openings therein directly above said one or more fingers, (n) said one or more fingers being engageable and downwardly displaceable through said access openings for engaging and disengaging said first and second detent elements, (o) said one of said bottom wall panel portions being provided with a plurality of said downwardly opening first detent elements corresponding to different widths of said tray, (p) individual index indicia being provided in association with each of said first detent elements, (q) a sizing chart being provided on an external side wall of said tray comprising a reference element for alignment with one side of a product container and a plurality of reference marks for referencing an opposite side of the product container as a function of its width, and (r) said reference marks being individually indexed correspondingly to the individual index indicia provided for each of the first detent elements.

5. A two-piece adjustable width tray for the organized display of multiple product containers, which comprises (a) first and second tray sections of molded plastic construction and of generally L-shaped cross section, each comprising a bottom wall portion and a side wall portion, (b) the bottom wall portion of each tray section including a smooth, generally continuous bottom wall panel portion of generally rectangular configuration extending longitudinally of a principal tray axis adjacent to and joined along outer edges thereof with the side wall portion of the tray section, (c) said bottom wall panel portions having top and bottom surfaces and inner edges along upper portions of said panel portions, and said inner edges being positionable in close relation, when said tray sections are adjusted to a minimum width configuration, (d) a plurality of longitudinally spaced apart bottom-forming fingers extending laterally from an inner edge of the bottom wall panel portion of each tray section, (e) said fingers being integral with said panel portions and having upper surfaces spaced below the top surfaces of said panel portions, (f) said panel portions each being formed on bottom surfaces thereof with laterally extending, downwardly opening recesses aligned with and arranged for the slidable reception of said fingers to accommodate width adjustment of said tray, whereby said fingers slide at least partially underneath super surfaces of said panel portions, (g) said fingers of at least one tray section and said downwardly opening recesses of at least the other tray section being formed with interengaging flanges along side edges thereof, whereby said first and second tray sections are interlockingly engaged for adjustable movements in the width direction.

(h) said bottom wall panel portions having a width at least as great as a length of the fingers received in the recesses in the bottom surfaces thereof whereby, when said tray sections are set to a minimum width configuration, with the inner edges of said panel portions in close relation, end extremities of said fingers are contained within said downwardly opening recesses, (i) said fingers being of sufficient length to bridge the entire space between the inner edges of said panel portions when said tray sections are set in any adjusted width, and said fingers of one tray section being of a width corresponding to spaces between fingers of the other tray section, whereby said bottom wall panel portions together with said fingers form an effectively continuous tray bottom in any adjusted position of said tray sections, (j) said bottom wall panel portions being of widths greater than a space between said inner edges thereof when said tray is set at a maximum width, (k) front edge portions of the bottom wall panel portions of said tray sections each being formed with an upwardly opening slot therein for the reception of a label holder, (l) said slots being open on at least one end thereof for the lateral insertion of a label holder, (m) a relatively rigid plastic label holder received and retained in said slot to provide product information and to serve as a forward stop for product containers pushed forwardly in said tray, (n) said label holder being formed with front and back panels and a forwardly projecting flange along its lower edge, (o) said upwardly opening slot being shaped to receive and support lower portions of said panels to retain said label holder in an upright orientation with substantial portions thereof projecting above the bottom wall panel portions, (p) said slot being further provided with a forward enlargement in a bottom portion thereof for receiving said forwardly projecting flange, (q) the upwardly projecting portions of said label holder serving as a front stop for product packages displayed in said tray and providing visible product information at the front of said tray, and (r) said label holder being slideably engaged in said upwardly opening slot to accommodate width adjustment of said tray sections independently of said label holder.

6. An adjustable width tray according to claim 1, wherein (a) the inner edges of said bottom wall panel portions are substantially straight and are positionable in substantially abutting relation when said tray sections are in a minimum width configuration, and (b) said fingers are positioned substantially entirely underneath said top surfaces when said tray sections are in a minimum width configuration.

7. An adjustable width tray according to claim 1, wherein (a) said bottom-forming fingers of said tray sections are formed with flanges along side edges thereof, whereby said first and second tray sections are interlockingly engaged for adjustable movements in the width direction.

* * * * *